United States Patent [19]

McGinnis

[11] Patent Number: 4,981,005

[45] Date of Patent: Jan. 1, 1991

[54] TAPERED POLE AND METHOD OF MAKING

[76] Inventor: Henry J. McGinnis, P.O. Box 7256, Fort Worth, Tex. 76111

[21] Appl. No.: 405,332

[22] Filed: Sep. 11, 1989

[51] Int. Cl.[5] ..... E04C 3/32

[52] U.S. Cl. ..... 52/731; 29/897.33; 228/178

[58] Field of Search ..... 138/171–177, 138/DIG. 11; 29/DIG. 41, 155 R, 155 C, 897.33; 52/720–733; 256/21, 22, DIG. 5; 228/172, 180; 219/93

[56] References Cited

U.S. PATENT DOCUMENTS

| | | | |
|---|---|---|---|
| 189,323 | 4/1877 | Root et al. | 256/DIG. 5 |
| 1,021,409 | 3/1912 | Huber | 52/730 |
| 3,656,515 | 4/1972 | Wogerbauer et al. | 138/DIG. 11 |
| 4,018,055 | 4/1977 | Le Clercq | 52/733 |

FOREIGN PATENT DOCUMENTS

| | | | |
|---|---|---|---|
| 690391 | 7/1964 | Canada | 52/694 |
| 33663 | 9/1924 | Denmark | 52/720 |
| 1182384 | 1/1959 | France | 52/726 |
| 649653 | 12/1962 | Italy | 52/731 |
| 15701 | of 1902 | United Kingdom | 52/726 |
| 27121 | of 1913 | United Kingdom | 29/155 R |

*Primary Examiner*—James L. Ridgill, Jr.
*Attorney, Agent, or Firm*—James E. Bradley

[57] ABSTRACT

A tapered metal pole has at least three ribs. Each rib has two parallel spaced apart walls. The inner edges of the walls of one rib will be welded to the inner edges of the walls of another rib. The walls of adjacent ribs will be at an angle relative to each other. An outer plate extends between the outer edges of each wall. The walls taper in width from a lower end to an upper end. Each of the walls of the ribs intersect with the walls of an adjacent rib at an angle.

11 Claims, 3 Drawing Sheets

TAPERED POLE AND METHOD OF MAKING

BACKGROUND OF THE INVENTION

1. Field of the Invention

This invention relates in general to tapered metal poles for supporting utility lines, lights and the like, and also to a method of manufacturing poles of these types.

2. Description of the Prior Art

Tapered metal poles are used for diverse purposes, such as for supporting utility lines, or for lighting. The taller metal poles often have a polygonal shape with more than four sides. The pole tapers from a larger base to a smaller dimension at its upper end.

These poles are formed in two halves. Each half is manufactured by bending a long sheet of steel to form the corners of the polygon shape. The two halves are then welded together by an automatic welding process.

While these poles perform satisfactorily, the manufacturing process requires large, expensive machinery. This requires extensive capital investment. It also makes the poles expensive.

SUMMARY OF THE INVENTION

In this invention, a tapered metal pole is provided that has three separate ribs. Each of the ribs has two parallel spaced apart walls. Each wall has an inner edge that is welded to an inner edge of an adjacent wall. The outer edges of each wall are the corners of an outer plate that joins the two walls of the rib. The distance from the inner edge to the outer edge of the wall decreases in an upward direction. This causes the outer plates to converge toward each other and provides a tapered configuration to the pole.

DETAILED DESCRIPTION OF THE INVENTION

Figure 6:
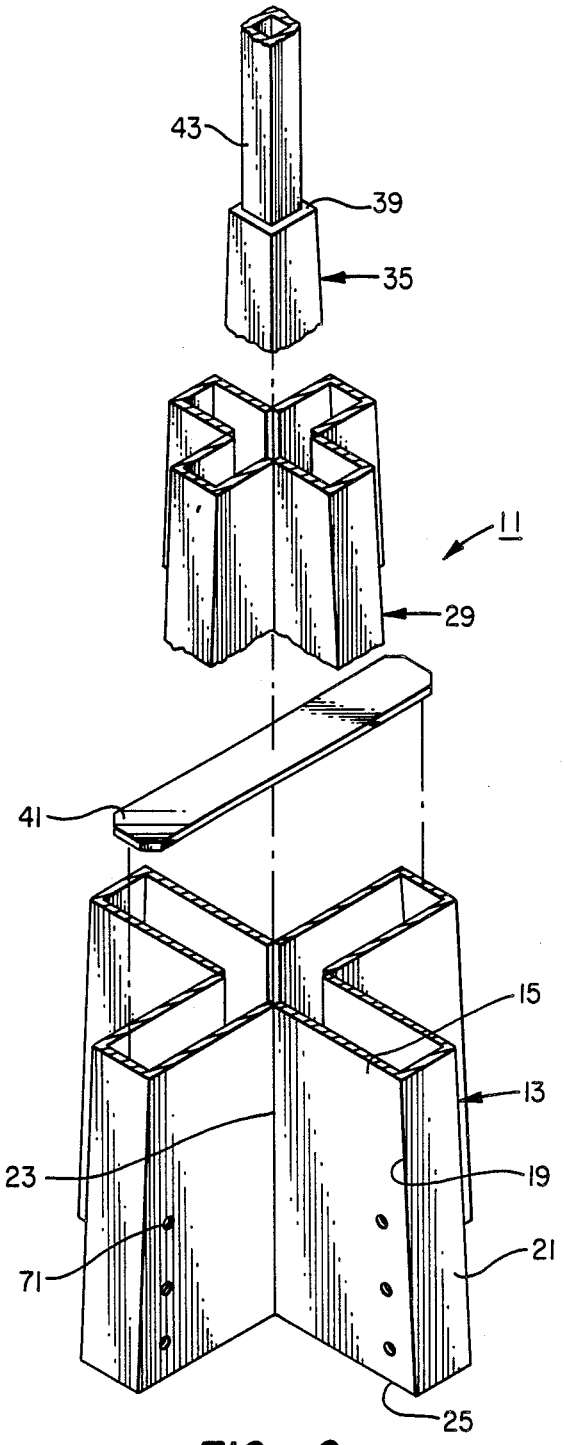
FIG. 6 is a perspective view of a portion of a metal pole constructed in accordance with this invention.

Referring to FIG. 6, pole 11 has a plurality of lower ribs 13. Each lower rib 13 has two parallel walls 15. The walls 15 each have an outer edge 19 which joins an outer plate 21. The outer plate 21 is perpendicular to the walls 15. Each outer edge 19 comprises a 90 degree corner that joins the outer plate 21 with each of the walls 15. Each wall 15 has an inner edge 23. Each inner edge 23 is welded to an inner edge 23 of an adjacent rib 13, with the intersecting walls 15 of the two adjacent lower ribs 13 being at an angle of 90 degrees relative to each other.

In the embodiment of FIG. 6, there are four of the lower ribs 13, each extending radially outward from the longitudinal axis of the pole, and each positioned 90 degrees from each other. Each wall 15 of each of the lower ribs 13 will be located in the same plane with a wall 15 of a rib 13 located on the opposite side of the axis of the pole 11. The lower ribs 13 that are adjacent or next to each other have walls 15 that are perpendicular to each other.

Figure 5:
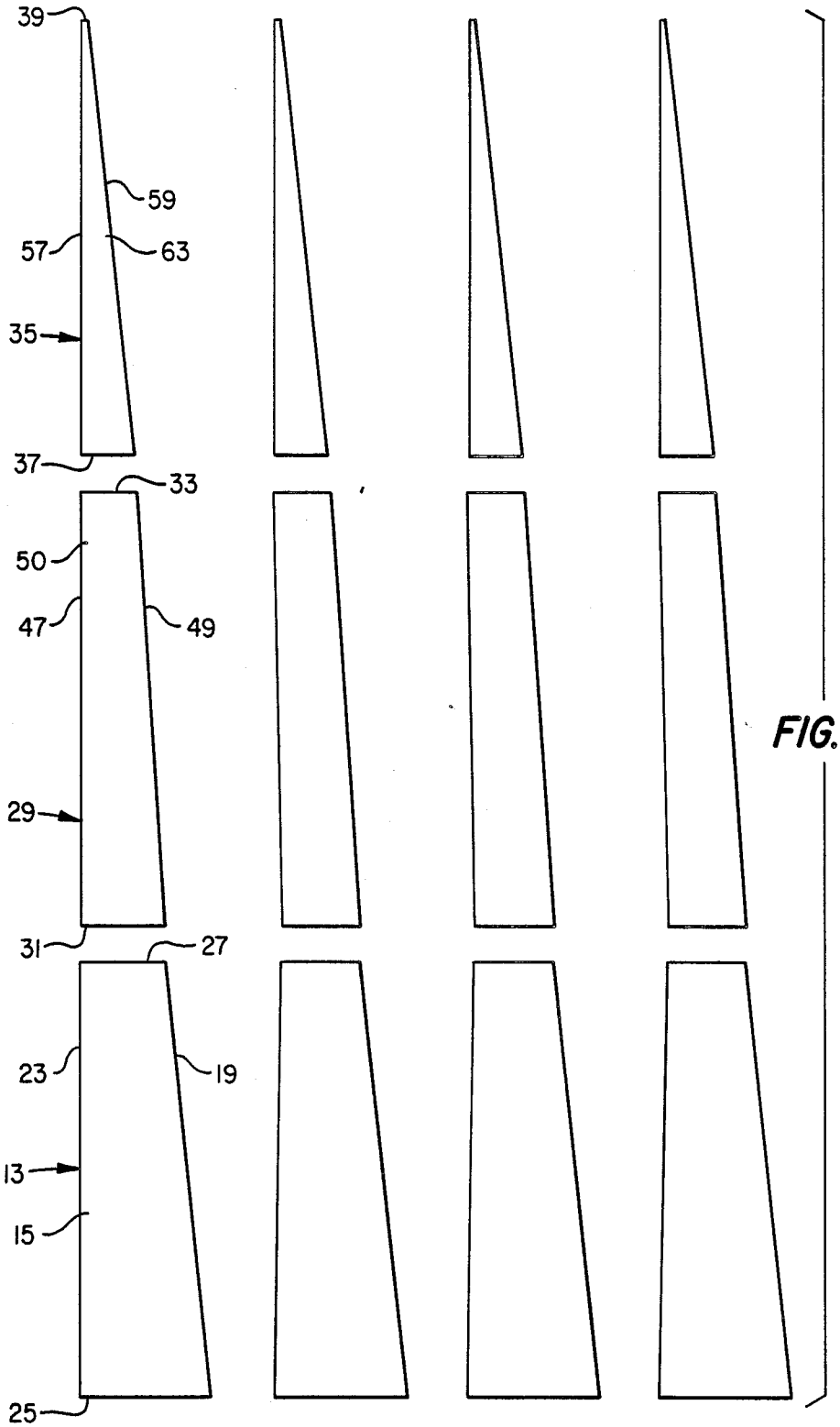
FIG. 5 is an exploded side view illustrating the ribs for lower, middle and upper sections of a metal pole.

FIG. 5 illustrates the lower ribs 13 as comprising a lower section of a pole 11 having three sections, lower, middle and upper. The lower ribs 13 are longitudinal members typically 20 feet or more in length. Each lower rib 13 has a lower end 25 which forms the base of the pole 11. Each lower rib 13 has an upper end 27.

The four lower ribs 13 shown in FIG. 5 will be welded together as shown in FIG. 6. As illustrated in FIG. 5, the width of the walls 15 from the outer edge 19 to the inner edge 23 of each lower rib 13 decreases when proceeding upward. This provides a taper to the lower ribs 13. The outer plate 21 will incline slightly relative to vertical, with the inner edge 23 being vertical. The distance from an outer plate 21 to an outer plate 21 of lower ribs 13 that are 180 degrees apart will decrease in an upward direction. In the embodiment shown, each lower rib 13 is identical in size.

In the embodiment shown in FIG. 5, a plurality of middle ribs 29 are welded on top of the lower ribs 13. The middle ribs 29 comprise a middle or second section to the pole 11 (FIG. 6). The middle ribs 29 have the same configuration as the lower ribs 13, but differ in dimension. The middle ribs 29 each have a lower end 31 that is welded to an upper end 27 of one of the lower ribs 13. The width of each upper end 27 of each of the lower ribs 13, measured in a general radial direction, will be the same as the lower end 31 of each of the middle ribs 29. The width of the upper end 33 of each of the middle ribs 29 will be less than the width of the lower end 31. The middle ribs 29 are identical in size in the embodiment shown.

Similarly, a plurality of upper ribs 35 will locate on top of the middle ribs 29, forming an upper or third section to the pole 11. The upper ribs 35 each have a lower end 37 and an upper end 39 and will be identical in size in the embodiment shown. The width of each of the upper ribs 35 decreases in an upward direction. The width of the lower end 37 of each of the upper ribs 35 is the same as the width of the upper end 33 of each of the middle ribs 29. The lower end 37 of each of the upper ribs 35 will be welded to one of the upper ends 33 of the middle ribs 29. The taper of the assembled pole 11 (FIG. 6) will be continuous, but need not be the same within each of the lower, middle and upper sections.

As shown in FIG. 6, one or more stiffening plates 41 may be located within the assembled pole 11. Stiffening plate 41 inserts within the interior of the lower ribs 13 and is welded in place. Stiffening plates 41 may be utilized at various points along the length of the assembled pole 11.

A square tube 43 may be inserted into the upper end 39 of the upper ribs 35. The square tube 43 may be used to support lighting, an antenna, or electrical lines. Also, transverse braces (not shown) may be bolted to the upper ribs 35 for supporting electrical wires, lighting and the like.

Figure 1:
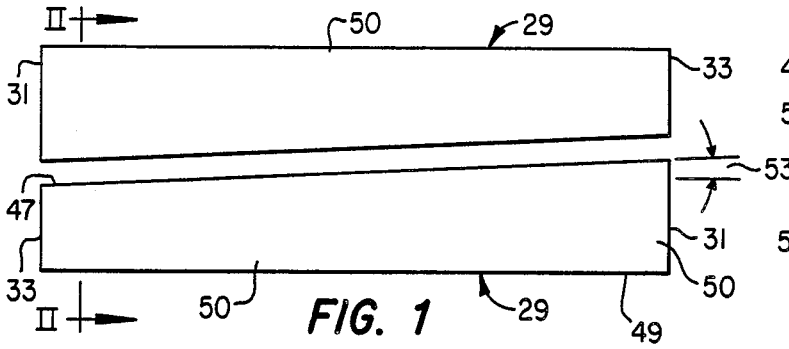
FIG. 1 is a side view of a rectangular tube, cut in half in order to make two ribs for a central section of a metal pole.
Figure 2:
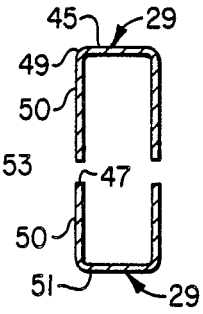
FIG. 2 is a cross-sectional view of the rectangular tube of FIG. 1, taken along the line II—II.

Pole 11 is constructed by first providing a rectangular tube 45, shown in FIGS. 1 and 2. Tube 45 will be initially a rectangular member formed of steel in a conventional manner. Two of the sidewalls will be wider than the other two, which will be referred to as plates herein. A cut will be made from one end to the other of the sidewalls of the tube 45, as shown in FIG. 1. This cut provides the inner edges 47 for the middle ribs 29. The corners of the tube 45 will become the outer edges 49 for the middle ribs 29. The cut sidewalls of the tube 45 will become the walls 50 for the middle ribs 29. The plates become the outer plates 51 for the middle ribs 29.

The cut which results in the inner edges 47 is made at an acute angle 53 relative to the corners or outer edges 49. This angle is selected to be the desired angle of taper for this portion of the pole 11. The cutting of the tube 45 in this manner provides two middle ribs 29, each having an upper end 33 and a lower end 31. To construct the pole 11 of FIG. 6, two of the metal tubes 45 will be used to form four of the middle ribs 29.

Figure 3:
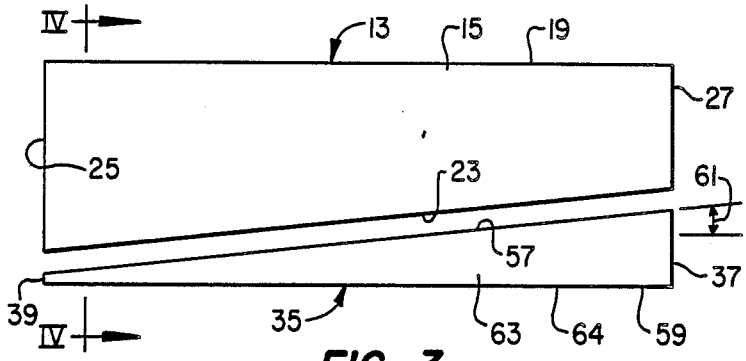
FIG. 3 is a side view of a rectangular tube, shown cut in half make a rib of a lower section of a metal pole and a rib of an upper section of a metal pole.
Figure 4:
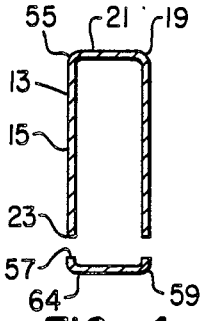
FIG. 4 is a cross-sectional view of the rectangular tube of FIG. 3, taken along the line IV—IV.
Figure 7:
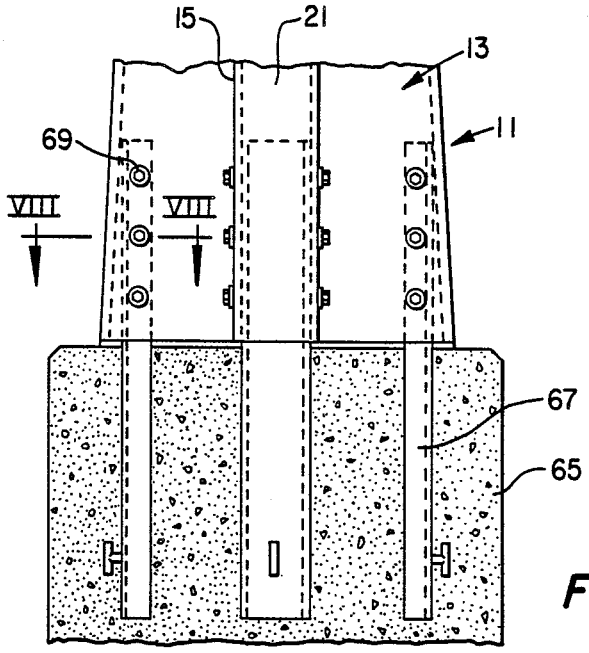
FIG. 7 is a side view of a portion of an assembled metal pole showing also the foundation in section.
Figure 8:
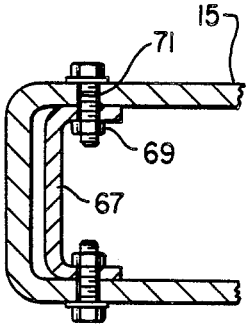
FIG. 8 is a sectional view of the metal pole of FIG. 7, shown along line VIII—VIII of FIG. 7.

Similarly, as shown in FIGS. 3 and 4, a tube 55 of the same dimensions as tube 45 will be cut. It will be cut along its length in a manner to provide an inner edge 57 to an upper rib 35. This cut also provides the inner edge 23 to one of the lower ribs 13. The outer edge 59 will be the corner between a wall 63 and an outer plate 64 for one of the upper ribs 35. The other portion of the tube 55 becomes a lower rib 13. The cut that results in the inner edges 23, 57 will be made at an acute angle 61. In the embodiment shown, angle 61 differs from the angle 53, thus the taper will not be identical throughout the length of the pole 11. Rather, angle 61 is approximately double that of angle 53. This produces a greater taper in the lower ribs 13 and upper ribs 35 than in the middle ribs 29. The thickness of each of the ribs 13, 29, 35 measured across the outer plates 21, 51, 64 is the same.

The cutting of the tube 55 will provide one lower rib 13 and one upper rib 35. Consequently, four of the tubes 55 must be used to provide for the four lower ribs 13 and four upper ribs 35. Once the components are cut as shown in FIGS. 1–4, the various components will be welded together as previously described and as shown in FIGS. 5 and 6.

The pole 11 may be secured to a foundation 65 of concrete or the like. Four vertical braces 67 extend upward. Each brace 67 locates within one of the lower ribs 13. Bolts 69 extend through holes 71 in the lower ribs 13 for bolting the lower ribs 13 to the braces 67.

The invention has significant advantages. A tapered metal pole may be formed without the need for expensive equipment to bend corners in long strips of metal as in the prior art. Rectangular tubes are readily available. Only cutting and welding equipment will be necessary to fabricate the poles.

While the invention has been shown in only one of its forms, it should be apparent to those skilled in the art that it is not so limited, but is susceptible to various changes without departing from the scope of the invention.

I claim:

1. A tapered metal pole, comprising in combination:

at least three ribs, each of the ribs having two parallel spaced apart walls, each of the walls having an inner edge and an outer edge;

an outer plate extending between the outer edges of each wall;

each of the walls intersecting one of the walls of another of the ribs at an angle and having its inner edge welded to the inner edge of the wall of the other rib;

the distance from the inner edge to the outer edge of each wall decreasing in an upward direction, causing the outer plates to converge toward each other and providing a tapered configuration to the pole; and the pole having at least first and second sections, each section having at least three of the ribs, the lower end of the second section having a dimension from the inner edge to the outer edge of each wall that is the same as the dimension from the inner edge to the outer edge of each wall of the first section, measured at the upper end of the first section, the lower end of the second section being secured to the upper end of the first section, each of the sections having a degree of taper that is constant throughout the length of each of the sections, the degree of taper of the second section differing from the degree of taper of the first section.

2. The pole according to claim 1 wherein the walls and outer plate of each rib are integrally formed together, with the outer edge of each wall being a corner formed between each wall and the outer plate.

3. The pole according to claim 1 wherein the pole has a longitudinal axis and wherein the pole further comprises at least one stiffening plate secured inside the pole perpendicular to the walls of the ribs and to the longitudinal axis of the pole.

4. A tapered metal pole having a longitudinal axis, comprising in combination:

four ribs, each of the ribs having two parallel flat spaced apart vertical walls, each of the walls having an inner edge and an outer edge;

an outer plate extending between the outer edges of each wall perpendicular to the walls, forming 90 degree corners at the junctions of the outer plate with the outer edges of the walls;

each of the walls joining one of the walls of another of the ribs at a 90 degree angle and having its inner edge welded to the inner edge of the wall said other rib, forming 90 degree corners at the junctions of the inner edges of each of the walls;

at least one flat stiffening plate extending perpendicular to the longitudinal axis of the pole within the interior of the pole, the stiffening plate being welded to the interior surfaces of at least two of the ribs;

the distance from the inner edge to the outer edge of each wall decreasing in an upward direction, causing the outer plates of the ribs to converge toward each other and providing a tapered configuration to the pole; and the pole having a first section and a second section, each having four of the ribs, the lower end of the second section having a dimension from the inner edge to the outer edge of each wall that is the same as the dimension from the inner edge to the outer edge of each wall of the first section, measured at the upper end of the first section, the lower end of the second section being secured to the upper end of the first section.

5. The pole according to claim 4 wherein the taper of the first section differs from the taper of the second section.

6. The pole according to claim 4 further comprising a base to which the pole is mounted, the base comprising:

a foundation of a concrete-like material;

a plurality of braces, each extending upward from the foundation into the interior of one of the ribs; and means including bolts for fastening the braces to the ribs.

7. A method of making a tapered metal pole, comprising in combination:

providing a plurality of metal rectangular tubes, each having two ends, and two parallel walls joined together by two parallel plates;

cutting each wall from one end to the other end at an acute angle relative to the plates to provide two separate ribs from each tube, each rib having one of the plates and a portion of two of the walls, each cut defining an inner edge of one of the walls, each of the walls having a width from the inner edge to the plate that increases in a direction from one end to the other end of the rib;

placing at least three of the ribs together with each of the walls of each rib intersecting one of the walls of another rib at an angle and welding the inner edges of the intersecting walls together to define the pole; and welding a flat stiffening plate into the interior of the pole to at least two of the ribs, with the plate perpendicular to a longitudinal axis of the pole.

8. The method according to claim 7 wherein four of the ribs are formed and welded together, with each of the walls intersecting a wall of another rib at a 90 degree angle.

9. A method of making a tapered metal pole, comprising in combination:

providing a plurality of metal rectangular tubes, each having two ends, and two parallel walls joined together by two parallel plates;

cutting each wall of two of the tubes from one end to the other end at a first angle relative to the plates to provide two separate and identical middle ribs from each tube, each of the four middle ribs having one of the plates and a portion of two of the walls, each cut defining an inner edge of one of the walls, each of the walls having a width from the inner edge to the plate that increases in a direction from one end to the other end of the rib;

cutting each wall of four more of the tubes from one end to the other end at a second angle relative to the plates to provide an upper rib and a lower rib from each tube, each of the upper and lower ribs having one of the plates and a portion of two of the walls, each cut defining an inner edge of one of the walls, each of the walls having a width from the inner edge to the plate that increases in a direction from one end to the other end of the rib, the width of the walls of the lower ribs being greater at the upper end than the width of the walls of the upper ribs at the lower end, the width of the walls of the lower ribs at the upper end being substantially the same as the width of the walls of the middle ribs at the lower end, the width of the walls of the upper ribs at the lower end being substantially the same as the width of the walls of the middle ribs at the upper end;

placing the lower ribs together with each of the walls of each lower rib intersecting one of the walls of another lower rib at a 90 degree angle and welding the inner edges of the intersecting walls together to provide an assembled lower rib section;

placing the middle ribs together with each of the walls of each middle rib intersecting one of the walls of another middle rib at a 90 degree angle and welding the inner edges of the intersecting walls together to provide an assembled middle rib section;

placing the upper ribs together with each of the walls of each upper rib intersecting one of the walls of another upper rib at a 90 degree angle and welding the inner edges of the intersecting walls together to provide an assembled upper rib section;

securing the middle rib section to the upper end of the lower rib section; and securing the upper rib section to the upper end of the middle rib section.

10. The method according to claim 9 further comprising:

welding a flat stiffening plate into the interior of the pole to at least two of the ribs in at least one of the rib sections, with the plate perpendicular to a longitudinal axis of the pole.

11. The method according to claim 9 wherein the second angle differs from the first angle, providing the same degree of taper of the pole in the lower and upper sections, but a different degree of taper of the pole in the middle section.

* * * * *